US007543340B2

(12) United States Patent
Kenny et al.

(10) Patent No.: US 7,543,340 B2
(45) Date of Patent: Jun. 9, 2009

(54) DUAL BERTH INVERTIBLE BUNK

(75) Inventors: Alan James Kenny, High Point, NC (US); Brian David Balicki, High Point, NC (US)

(73) Assignee: Volvo Trucks North America, Greensboro, NC (US)

( * ) Notice: Subject to any disclaimer, the term of this patent is extended or adjusted under 35 U.S.C. 154(b) by 0 days.

(21) Appl. No.: 11/667,573

(22) PCT Filed: Nov. 19, 2004

(86) PCT No.: PCT/US2004/039127

§ 371 (c)(1),
(2), (4) Date: May 11, 2007

(87) PCT Pub. No.: WO2006/055005

PCT Pub. Date: May 26, 2006

(65) Prior Publication Data

US 2007/0294822 A1 Dec. 27, 2007

(51) Int. Cl.
*A47C 17/66* (2006.01)
*A47C 17/80* (2006.01)

(52) U.S. Cl. ..... 5/9.1; 5/118

(58) Field of Classification Search ..... 5/9.1, 5/118, 8, 10.1, 498; 24/72.5
See application file for complete search history.

(56) References Cited

U.S. PATENT DOCUMENTS

| | | | | |
|---|---|---|---|---|
| 544,982 | A * | 8/1895 | Hoskins | 297/62 |
| 737,561 | A * | 9/1903 | Arnold | 5/9.1 |
| 2,316,710 | A * | 4/1943 | Parke | 105/315 |
| 2,531,987 | A * | 11/1950 | Jones | 105/315 |
| 2,550,599 | A * | 4/1951 | Reed | 5/9.1 |
| 3,311,932 | A * | 4/1967 | Ahola | 5/9.1 |
| 3,594,832 | A * | 7/1971 | Bryks | 5/9.1 |
| 3,811,138 | A * | 5/1974 | Del Missier | 5/9.1 |
| 5,875,502 | A * | 3/1999 | Kolbenstetter et al. | 5/136 |
| 6,367,839 | B1 * | 4/2002 | Langhoff | 280/751 |
| 7,097,204 | B2 * | 8/2006 | Jessup et al. | 280/748 |
| 7,150,471 | B2 * | 12/2006 | Langhoff et al. | 280/749 |
| 2007/0294822 | A1 * | 12/2007 | Kenny et al. | 5/9.1 |

FOREIGN PATENT DOCUMENTS

| | | | |
|---|---|---|---|
| EP | 36758 | A1 * | 9/1981 |
| GB | 2011252 | A * | 7/1979 |

* cited by examiner

*Primary Examiner*—Robert G Santos
(74) *Attorney, Agent, or Firm*—Martin Farrell

(57) ABSTRACT

A dual berth bunk (20) for a sleeper cab (10) or other confined space includes a bunk frame (22) mounted for pivoting or rotating inversion. Berths (25*a*, 25*b*), or sleeping surfaces, are provided on the opposite sides of the bunk frame and a berth may be selectively positioned for use by pivoting or rotation of the bunk frame. A latch (56) or other device may be used to secure the bunk frame in the selected position. Retaining devices (104, 106) retain bedding in the berths when the berth in a downward inverted orientation.

11 Claims, 3 Drawing Sheets

DUAL BERTH INVERTIBLE BUNK

TECHNICAL FIELD

The invention relates to bunks or beds for relatively confined spaces, such as in truck sleeper cabs, boats, campers and the like. More particularly, the invention relates to a bunk that has two useful berths or sleeping surfaces on opposite sides.

BACKGROUND ART

Some over-the-road or long haul tractor-trailers are made with extended cabs to accommodate a living space, including a bunk, for the vehicle operator to use during off hours. When tractor-trailers are operated by an operator team, it becomes necessary to provide sleeping space for the additional team members. The operators may share a single bunk, which presents difficulties with convenience, hygiene and personal preferences. For example, the operators will have to make up the bunk for each use with their own sheets, blankets and pillows, but may have to share a mattress. Alternatively, a second bunk can be provided, which takes up space and can add complication and expense to the cab configuration.

DISCLOSURE OF INVENTION

The invention overcomes the problems in the art by providing a single bunk having two berths, that is, two sleeping surfaces, each located on opposite sides of the bunk, the bunk being invertible to provide use on either of its opposing sleeping surfaces, each berth capable of holding individual bedding for use by an operator.

According to the invention, a dual berth invertible bunk includes a bunk frame having a first berth and an oppositely located second berth. Each berth provides a support surface for bedding, for example, a mattress or equivalent, bed sheets, blankets, pillows, and the like. Mounting means supports the bunk frame in the cab and permits movement for selectively positioning the first or second berths in an upwardly facing, horizontal position for use. The mounting means permits pivoting or rotational movement to position the selected berth in the upwardly facing position. The non-selected berth is then positioned downward facing. The bunk frame is secured in the selected position by a stop, latch or other convenient device.

Advantageously, the bunk frame takes up approximately the same space as a conventional bunk, and so requires little rearrangement of the cab interior space. When a driver team includes two members, a single invertible bunk according to the invention may be provided in the cab. Of course, a second invertible bunk can be provided if the driver team includes more than two members with little adaptation needed for cabs that accommodate two bunks.

According to another aspect of the invention, in addition to being invertible, the bunk frame may be movable between stored and deployed positions. According to one embodiment, the mounting means includes or is formed as pivot arms for pivoting the bunk frame between a deployed position extended horizontally outward from a wall of the cab, and a stored position in close proximity to the wall or in a recess in the wall. Alternatively, the mounting means may be engaged on vertical supports or guides on which the bunk frame can be moved upward to be stored near the interior roof of the cab, or alternatively, lowered to be converted into a bench or table.

Retaining devices retain the bedding, for example, a mattress, pillow, sheets, and covers, on each of the berths when the bunk frame is in the downward, or inverted, position. The retaining means is releasable so not to interfere with use of the bedding.

The retaining means can be flexible elements such as straps, sheets, webs, or netting that is fastened on the bunk frame and extended across the frame and over the bedding. The retaining means may be releasably fastened on the bunk frame, or releasably fastened on one edge and permanently fastened on the other edge, as may be convenient.

According to another aspect of the invention, the retaining means may include a retraction device, such as a spring driver and core as used in roller blinds, to retract the retaining means to a stored position upon release from the fastener.

According to one embodiment, the bunk frame includes a deck or platform sufficiently rigid and planar to support a mattress or the like, surrounded by side and end rails. The side and end rails are raised relative to the platform to form a receiving space for the bedding on each sleeping support surface.

BRIEF DESCRIPTION OF DRAWINGS

The invention will be better understood by reference to the following detailed description read in conjunction with the appended drawings, in which drawings.

BEST MODE FOR CARRYING OUT THE INVENTION

Figure 1:
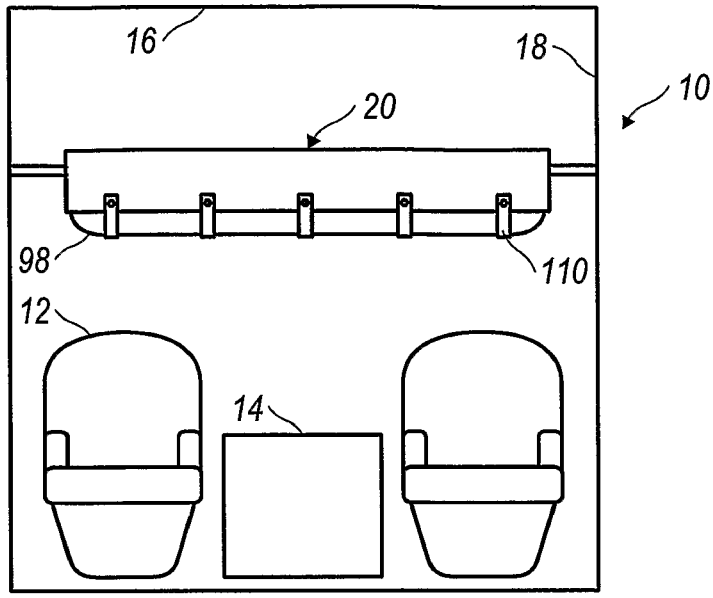
FIG. 1 is schematic view of an interior of a sleeper cab showing a living space including a bunk.

As shown schematically in FIG. 1, the interior of an over-the-road sleeper cab 10 includes space bounded by a ceiling 16 and walls 18 and amenities for rest and office work. The cab 10 as shown includes chairs 12, a table 14, and a bunk 20. A work station, for example, a movable desk or work top that can be positioned at either of the chairs, may be included to allow an off-duty operator to do reporting and record keeping tasks. Other features or fixtures may be included as are known or desirable, and the illustration here is not meant to be limiting. The bunk 20 is mounted in the cab living space above the chairs with sufficient space above and below the bunk for safety and comfort.

Although the following description and drawings relate to a single bunk in a truck sleeper cab, the invention is not to be construed as limited thereto. A sleeper cab may have two or more bunks as space allows for driver teams of more than two members. Also, the bunk according to the invention is not limited to use in trucks, but may also be used in boats, campers, and other places where space is limited for sleeping accommodations.

Figure 2:
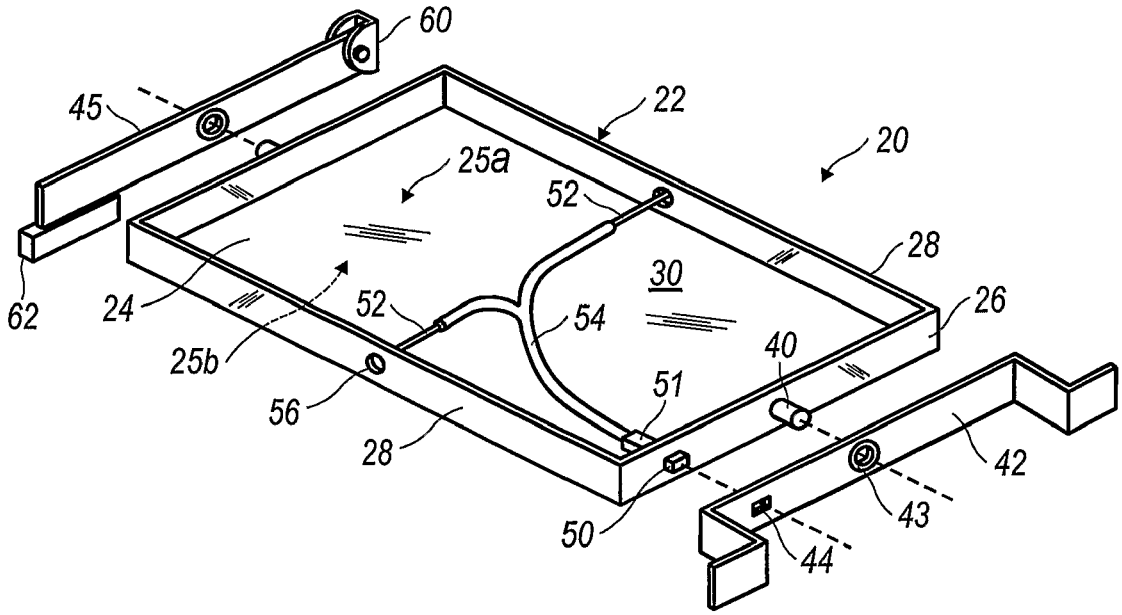
FIG. 2 is a schematic view of a dual berth, invertible bunk in accordance with the invention.

An illustrative embodiment of the bunk in accordance with the invention is shown in FIG. 2. The figure is shown in exploded view for clarity. The bunk 20 in accordance with the invention has two usable sleeping surfaces or berths 25*a*, 25*b* and may be inverted to deploy a selected berth, and its associated bedding, for use. The term "bedding" should be understood in a general sense to include any or all of a mattress or equivalent (pad, futon, etc.), bed sheets, blankets, pillows and the like.

The bunk 20 includes a frame 22 having a deck or platform 24 providing a first berth 25*a* (shown facing upward in the drawing) and a second berth 25*b* (not visible). The deck 24 is sufficiently rigid and planar to allow each berth to support the bedding (not shown) for use. End rails 26 are fixed on the laterally extending ends of the deck 24 and side rails 28 are fixed on the longitudinally extending sides of the deck. The end rails 26 and side rails 28 extend perpendicularly from the deck 24 to define receiving spaces 30 for both opposite first 25*a* and second 25*b* berths. The rails 26, 28 are shown as being formed as solid panels, but other rail shapes or configurations (e.g., bars or tubes) may be used as is convenient or aesthetically pleasing.

A mounting system supports the bunk frame 22 in the cab so that the bunk frame may be inverted to position selectively either the first berth 25*a* or the second berth 25*b* in an upwardly facing deployed position. In FIG. 2, the first berth 25*a* is shown in the deployed position. According to one embodiment of the invention, the mounting system may include pivot shafts or pins 40 mounted on the bunk frame 22 that engage a bracket 42 mounted to the cab. The pins 40 allow the bunk frame 22 to rotate along its longitudinal center axis. Suitable bearings or bushings 43 may be included in the bracket 42 as is known.

The bunk 20 may be secured against rotation by any suitable device. For example, a spring-loaded pin 50 as shown in FIG. 2 may be mounted in the bunk frame 22 to engage a catch or hole 44 in the mounting bracket 42. The pin 50 is biased by a spring 51 to a position extended from the bunk frame 22 to engage the catch. The pin 50 is connected by cables 52 routed through sheaths 54 to pull rings 56 mounted on each side of the bunk frame 22. Pulling a ring 56 causes the pin to retract into the bunk frame 22 to release the frame from the mounting bracket 42.

The pin 50 and cables 52 are shown exposed in the bedding receiving space 30 for the clarity of the illustration. It will be understood that the deck 24 may include a conduit, passage or cavity to accommodate the securing device components.

Alternatively, the securing pin or latch may be mounted to either or both mounting brackets 42, rather than the bunk frame, to engage receptacles or catches in the bunk frame 22.

The bracket 42 shown in FIG. 2 illustrates an embodiment in which the bunk 20 has a fixed position relative to the cab wall. Of course, a bunk 20 mounting in a fixed position would have brackets such as bracket 42 mounting the bunk at opposite ends. According to another aspect of the invention, the bunk 20 is movable between a deployed position (shown in FIG. 1) and a stored or stowed position. The stowed position may be adjacent to or in a recess (not shown) in the ceiling 16 or a wall 18 of the cab. FIG. 2 illustrates one device for stowing the bunk 20. An alternative mounting bracket 45 is configured as a pivot arm, having a pivot mount 60 fixed to the wall of the cab. A support or stop 62 is provided to support the mounting bracket 45 in the deployed position. To stow the bunk 20, the mounting brackets 45 are pivoted to position the bunk against the cab wall, and a suitable locking device secures the brackets and bunk in the stowed position.

Alternatively, a pivotable linkage may be attached to the mounting brackets 45 to support them in the deployed position and allow the mounting bracket 45 and bunk 20 to be pivoted between a stowed position and a deployed position.

Figure 3:
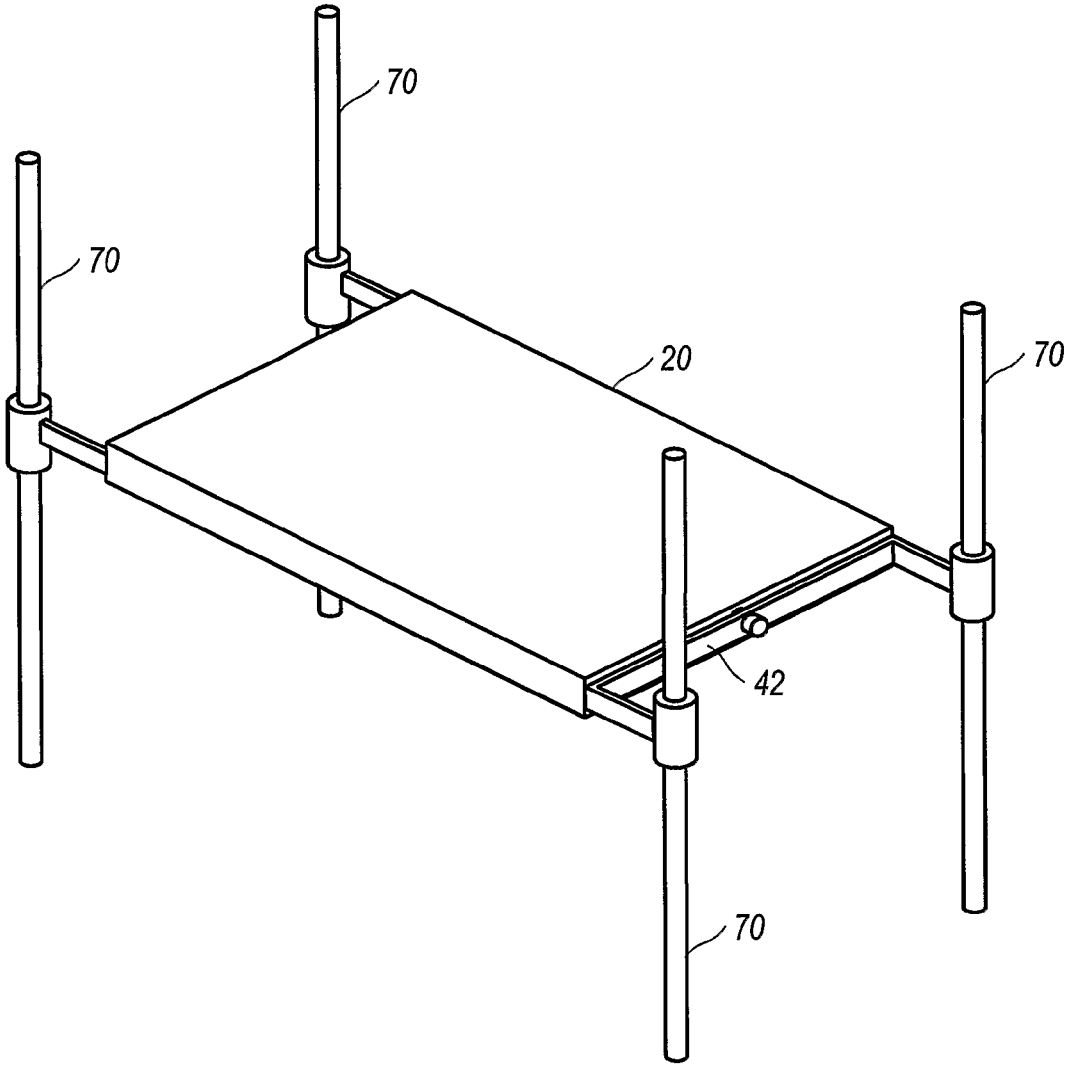
FIG. 3 is a schematic view of an alternative device for stowing the bunk when not in use.

For stowing the bunk 20 adjacent the ceiling of the cab, the mounting bracket 42 may be mounted on vertical rails or guides 70, shown schematically in FIG. 3, which permit the mounting bracket and bunk 20 to move upward to the ceiling or downward to the deployed position. A securing device to secure the bunk selectively in the stowed or deployed position is provided. A spring, counterweight, or other assisting device may be provided to facilitate movement of the bunk.

Figure 4:
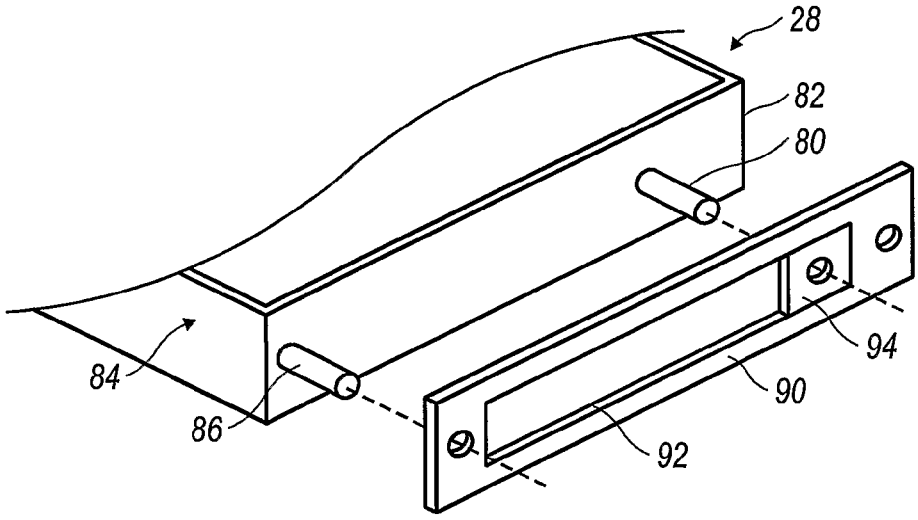
FIG. 4 schematic view of an alternative embodiment of the mounting and inversion system for the bunk.

FIG. 4 illustrates an alternative mounting device for the invertible bunk. According to this embodiment, the bunk 20 includes a pivot pin 80 mounted on a pivot side 82 of the bunk, adjacent one of the side rails 28. A mounting bracket 90 includes a guide 92 with a follower 94 mounted in the guide for movement therein. The follower 94 engages the pivot pin 80 to provide load support and, as discussed below, to permit the pivot side 82 of the bunk to be moved along the guide 92.

A latch 86 on the bunk frame 24 is positioned to engage a catch in the mounting bracket 90 to support and secure the free side 84 of the bunk frame. When the latch 86 is released, the free side 84 of the bunk 20 may be lifted to pivot the pivot side 82 on the follower 94. The pivot pin 80 and follower 94 are moved to the opposite end of the guide slot 92, and the bunk is inverted to change the position of the berths. Because of the weight of the bunk 20, it may be advantageous to include a drive motor, spring, counterbalance or other assist for inverting the bunk.

Figure 5:
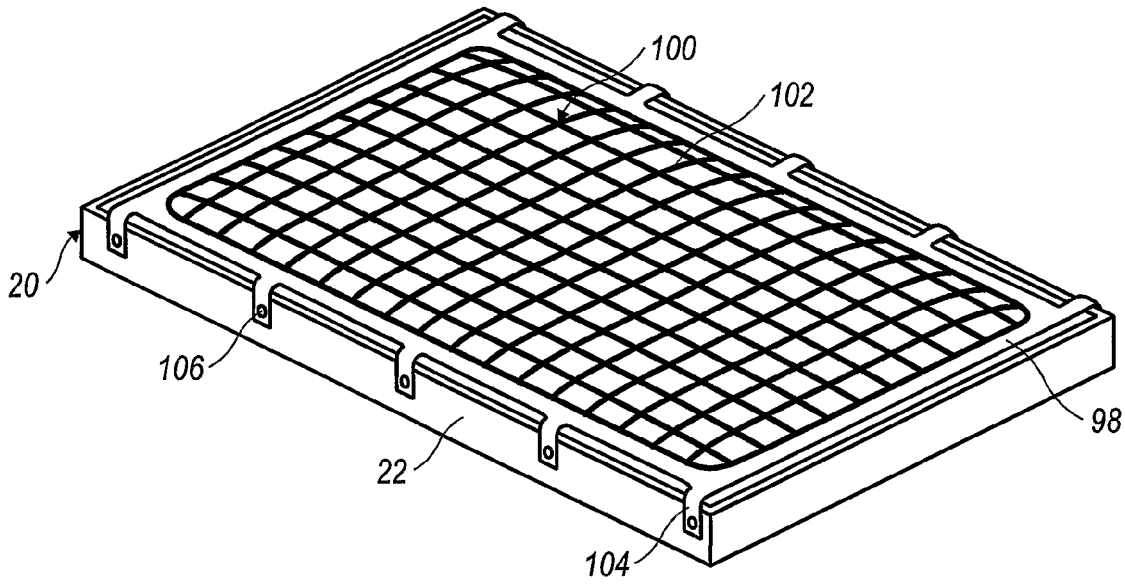
FIG. 5 illustrates a bedding retaining system for the bunk.

FIG. 5 illustrates one embodiment of a bedding retaining device for the invertible bunk 20. FIG. 5 shows a bunk frame 22 with bedding 98 on the berth 25*a*. Retaining devices 100 are secured to the bunk frame to retain the mattress on the berth 25*a*. In the illustrated embodiment, the retaining devices 100 include netting 102 having straps 104 attached to the bunk frame 22. Alternatively, other sheeting or webbing material could be used.

The straps 104 may be attached to the bunk frame 22 by snaps 106, as illustrated, or another suitable device. It may be convenient to attach the straps 104 permanently to one side of the bunk frame 22 and include a way to store the netting on the fixed side of the bunk frame. For example, a pouch or pocket may be provided. Alternatively, the fixed straps may be attached to a core having a spring driver similar to a window shade, which can be activated to coil the retaining device 100.

As seen in FIG. 1, another alternative is a plurality of straps 110 disposed to extend across the bunk frame 22 and bedding 98.

The invention has been described in terms of preferred embodiments and practices for the convenience of the description, but the scope of the invention will be understood by those skilled in the art to be defined by the following claims.

The invention claimed is:

1. A dual berth bunk, comprising:

a bunk frame having a first berth surface and an oppositely located second berth surface;

pivot arms pivotally mountable to a support structure and connected to the bunk frame for selectively pivoting the bunk frame between a stowed position adjacent the support structure and a deployed position extended from the support structure;

mounting means for supporting the bunk frame on the pivot arms and for selectively rotating the bunk frame about an axis for positioning the bunk frame between a first position with the first berth surface in an upward facing horizontal orientation and a second position with the second berth surface in an upward facing horizontal orientation; and, securing means for securing the bunk frame in the selected position.

2. The dual berth bunk as claimed in claim 1, further comprising retaining means for retaining a first bedding element at the first berth surface and a second bedding element at the second berth surface.

3. The dual berth bunk as claimed in claim 2, wherein said retaining means comprises flexible elements mounted to a first side of the bunk frame to extend across the berth surfaces and releasable fastening means to fasten the flexible elements to an opposite side of the bunk frame.

4. The dual berth bunk as claimed in claim 3, further comprising retraction means for retracting the flexible elements to a stored position.

5. The dual berth bunk as claimed in claim 1, wherein the axis of the means for rotating the bunk frame is a centrally located axis.

6. The dual berth bunk as claimed in claim 1, wherein the axis of the means for rotating the bunk frame is a laterally located axis.

7. The dual berth bunk as claimed in claim 6, wherein the mounting means comprises track means and the bunk frame includes follower means on a mounted side engaged with the track means for sliding movement of a mounted side between a first and a second position and pivoting of the bunk frame about the mounted side to orient one of the first berth surface and second berth surface in the selected orientation.

8. The dual berth bunk as claimed in claim 1, wherein the securing means comprises a latch to releasably inter-engage the bunk frame and mounting means.

9. The dual berth bunk as claimed in claim 8, wherein the latch comprises a spring-loaded pin biased for engagement with a bracket of the mounting means, the pin connected to a cable and pull for selectively releasing the pin from engagement.

10. A dual berth bunk, comprising:

a bunk frame having a first berth surface and an oppositely located second berth surface;

a mounting mechanism that supports the bunk frame for selective positioning between a first position with the first berth surface in an upward facing horizontal orientation and a second position with the second berth surface in an upward facing horizontal orientation, the mounting mechanism further comprising vertical guides for moving the bunk frame vertically along the guides between a deployed position and a stowed position above the deployed position; and, a securing arrangement that secures the bunk frame in the selected position.

11. A dual berth bunk for a truck sleeper cab, comprising:

a truck sleeper cab having walls defining an interior space;

a bunk frame having a first berth surface and an oppositely located second berth surface;

pivot arms pivotally mounted to a wall of the sleeper cab for pivoting movement between a deployed position extending from the wall into the interior space and a stowed position in proximity to the wall;

mounting means for supporting the bunk frame on the pivot arms for rotation between selectable alternative positioning of the first berth surface and the second berth surface in an upward facing horizontal orientation; and, securing means for securing the bunk frame in the selected position.

* * * * *